US005211001A

United States Patent [19]

Mori

[11] Patent Number: 5,211,001

[45] Date of Patent: * May 18, 1993

[54] SPINNING APPARATUS

[75] Inventor: Shigeki Mori, Ohtsu, Japan

[73] Assignee: Murata Kikai Kabushiki Kaisha, Kyoto, Japan

[ * ] Notice: The portion of the term of this patent subsequent to Sep. 15, 2009 has been disclaimed.

[21] Appl. No.: 760,168

[22] Filed: Sep. 16, 1991

[30] Foreign Application Priority Data

Sep. 18, 1990 [JP] Japan ..... 2-97655[U]

[51] Int. Cl.[5] ..... D01H 1/115

[52] U.S. Cl. ..... 57/328; 57/333; 57/343

[58] Field of Search ..... 57/5, 6, 403, 328, 333, 57/341, 343

[56] References Cited

U.S. PATENT DOCUMENTS 4,827,710 5/1989 Nishimura ..... 57/328

4,845,932 7/1989 Sakai et al. ..... 57/328 X 4,958,487 9/1990 Suganuma et al. ..... 57/328

4,986,066 1/1991 Morrison ..... 57/333

5,088,265 2/1992 Suganuma et al. ..... 57/328

FOREIGN PATENT DOCUMENTS 104933 5/1991 Japan ..... 57/333

*Primary Examiner*—Joseph J. Hail, III

*Attorney, Agent, or Firm*—Spensley Horn Jubas & Lubitz

[57] ABSTRACT

A pneumatic spinning apparatus for producing yarns having characteristics equal to those of ring spinning yarns. In the spinning apparatus, a guide member is mounted with an extreme end thereof faced to an inlet of a spindle within a nozzle block which exerts a turning air stream on a bundle of fibers moved out of a draft device, and a distance from the spindle inlet to a nip point of front rollers of the draft device is defined in a specified range.

8 Claims, 2 Drawing Sheets

SPINNING APPARATUS

FIELD OF THE INVENTION

This invention relates to an apparatus for producing spun yarns by exerting a turning air stream on a bundle of untwisted short fibers drafted by a draft device to twist it.

DESCRIPTION OF THE PRIOR ART

As a conventional pneumatic spinning apparatus, a spinning apparatus described below has been known (see U.S. Pat. No. 4,845,932).

This apparatus comprises a rotational spindle having a passage through which passes a bundle of fibers moved out of front rollers of a draft device, and an air jet nozzle for exerting a turning air stream on a portion in the vicinity of an inlet of the spindle to separate an end of fibers from the bundle of fibers, said fiber end being wound around the bundle of fibers.

Yarns produced by the aforementioned conventional spinning apparatus have properties in which around the zero twist or low twist core fibers are helically wound, and the aforesaid yarns are different in external appearance and inferior in strength to ring yarns in which most of fibers are in the twisted state.

OBJECT AND SUMMARY OF THE INVENTION

An object of this invention is to provide an apparatus which can produce yarns having characteristics equal to those of ring yarns in a pneumatic spinning apparatus as described.

For achieving the aforesaid object, according to a spinning apparatus of the present invention, a guide member is mounted with an extreme end thereof faced to an inlet of a rotational or stationary spindle within a nozzle block which exerts a turning air stream on a bundle of fibers moved out of a draft device, and the relationship between a distance l from the spindle inlet to a nip point of front rollers of the draft device and an average fiber length $L_o$ of the bundle of fibers is defined by the formula below:

$$L_o - L_o/2 < l < L_o + L_o/2$$

In the spinning apparatus constructed as described above, the bundle of fibers moved out of the draft device is sucked into the nozzle block, and exposed to the turning air stream in the vicinity of the inlet of the spindle, after which it is slightly twisted. At that time, all the fibers of the bundle of fibers are positioned around the guide member and directly exposed to the air stream to receive a force to be separated from the bundle of fibers. However, since the extreme end of the fiber positioned at the inlet of the spindle is being twisted, it is not easily separated. The rear end of the fiber separated is wound around the outer periphery of the spindle and extended outwardly. That fiber is gradually drawn while being turned around the bundle of fibers as the latter travels, and most of the fibers are helically wound to obtain a real twist spun yarn.

DESCRIPTION OF THE PREFERRED EMBODIMENT

An embodiment of the spinning apparatus according to the present invention will be described with reference to the drawings.

Figure 1:
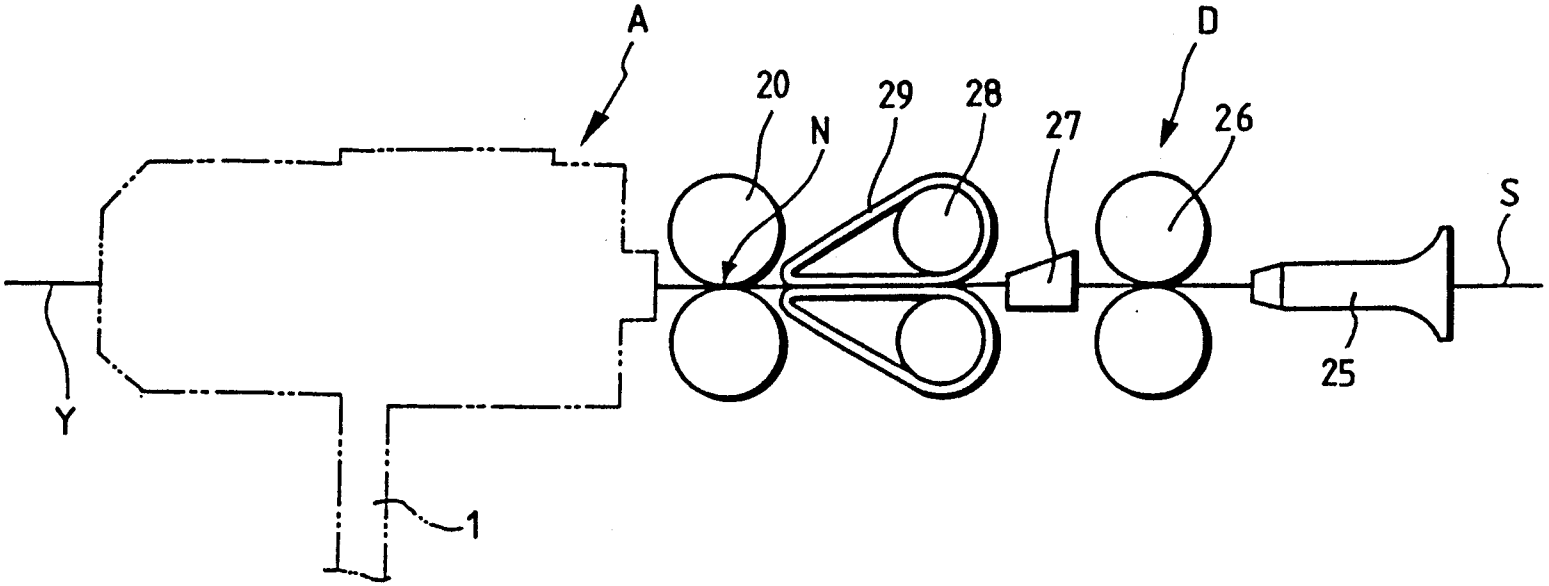
FIG. 1 is a schematic view showing an embodiment of a spinning apparatus to which is applied an apparatus according to this invention.

This spinning apparatus A is arranged next to a draft part D comprising a pair of back rollers 26, a pair of middle rollers 28 each having an apron 29, and a pair of front rollers 20, which are arranged continuous to a sliver charge guide 25 as shown in FIG. 1. In the figure, a line extending laterally denotes a travel path of a bundle of fibers S and a yarn Y. Numeral 27 denotes a sliver-width defining guide.

The spinning apparatus A will be described in detail with reference to FIG. 2.

Reference numeral 1 designates a support plate secured to a frame. To the support plate 1 are secured a hollow cylindrical bearing 2, a spindle 6 an a casing 3 for a rotary member 9. This casing 3 is composed of a pair of front and rear split sections, which are fixed by screws.

Within the bearing 2 is rotatably supported the spindle 6 through bearings 4 and 5, and a hollow pulley 7 is slipped over the spindle 6.

Reference numeral 8 designates an endless drive belt extended along the unit in contact with the outer periphery of the pulley 7 to rotate the spindle 6 at high speeds. The rotary member 9 is integrally provided at a position ahead of the bearing 5 of the spindle 6.

A fiber-bundle passage 10 extends through the spindle 6, and the center of the passage 10 and the center of the casing 3 are positioned on one and the same straight line coincided with the travel path of the bundle of fibers S. An outside diameter of an inlet **6*a* of the spindle 6 is sufficiently small, and a portion continuous to the inlet 6*a* is formed with a conical portion 6*b* whose outside diameter increases toward the rotary member 9. A portion for covering the spindle 6 and the rotary member 9 of the casing 3 is that the neighbourhood of the inlet 6*a* of the spindle 6 forms a small-diameter cylindrical hollow chamber 11, and a portion continuous to the hollow chamber 11 forms a conical hollow chamber 12** which is opened at a large angle.

A portion ahead of the small-diameter hollow chamber 11 is cylindrical of a large-diameter slightly larger than a diameter of the extreme end of the spindle 6 by a nozzle block 23, said cylindrical portion serving as a guide passage of the bundle of fibers S. On this side of the conical hollow chamber 12 are formed an annular hollow chamber 14 and a tangential air escape hole 15 continuous thereto. An air suction pipe is connected to the air escape hole 15.

The casing 3 is interiorly formed with an air reservoir 16 adjacent to the nozzle block 23. The nozzle block 23 is formed with four air jet nozzles 17 which are directed toward the inlet **6*a* of the spindle 6 from the air chamber 16 and directed in a tangential direction with respect to the hollow chamber 11, and an air hose 19 is connected to the air reservoir 16 through a hole 18. The direction of the nozzle 17 is set to the same direction as the rotating direction of the spindle 6**.

Compressed air supplied from the hose 19 flows into the air reservoir 16, after which it is jetted into the hollow chamber 11 from the nozzle 17 to generate a high-speed turning air stream in the vicinity of the spindle inlet 6a.

The air stream is turned within the hollow chamber 11 and scattered outwardly while slowly turning within the conical hollow chamber 12, after which the air stream is guided toward the escape hole 15 and discharged. At the same time, this air stream generates a flow of suction air which flows from a nip point N between the front rollers 20 into a hollow portion of the casing 3.

Reference numeral 21 designates a cap fitted on the rear end of the bearing 2.

The guide member support member 13 is secured to the inner wall of the nozzle block 23. The guide member support member 13 is columnar shape whose one end is conically protruded to form a gap 24 adjacent to the nozzle block 23 with one side thereof cutaway, said gap 24 constituting a guide passage for the bundle of fibers S. If one end of the guide member support member 13 is conically protruded as described above, the fibers of the bundle of fibers S supplied from the gap become hard to be wound, and even if they are wound, they are in an extremely small amount and easily unwound. The guide member support member 13 is bored lengthwise with a hole matched to a center line of the passage 10 of the spindle 6, and a pin-like guide member 22 is inserted into the hole. The guide member 22 is protruded from the hole of the guide member support member 13 to render the extreme end free so as to face to the inlet 6a of the spindle 6. This guide member 22 is effective if it is formed into a conical configuration similarly to the guide member support member 13. According to the way of installation of the guide member 22 as described above, the inlet side of the apparatus is not blocked by the guide member 22, and therefore, an entry of the bundle of fibers S is not impaired.

The guide member 22 has a diameter smaller than that of the passage of the inlet 6a of the spindle 6, and the extreme end thereof is formed by a smooth curve.

Figure 2:
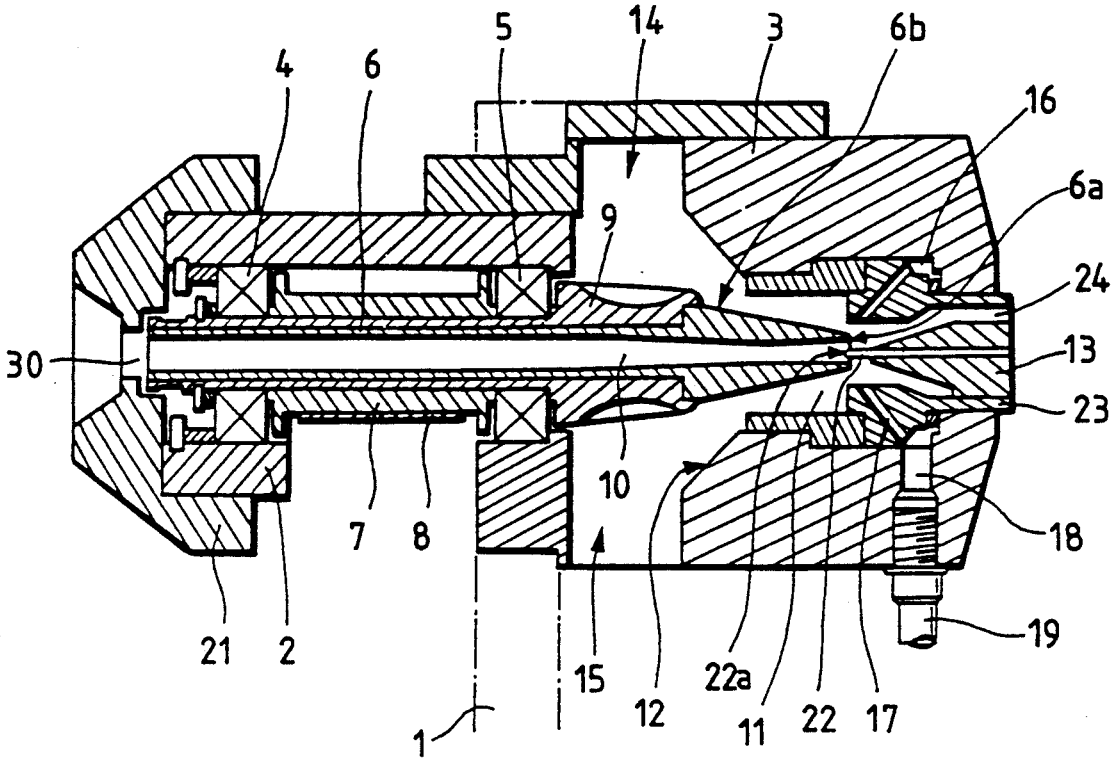
FIG. 2 is a sectional view of the apparatus.
Figure 3:
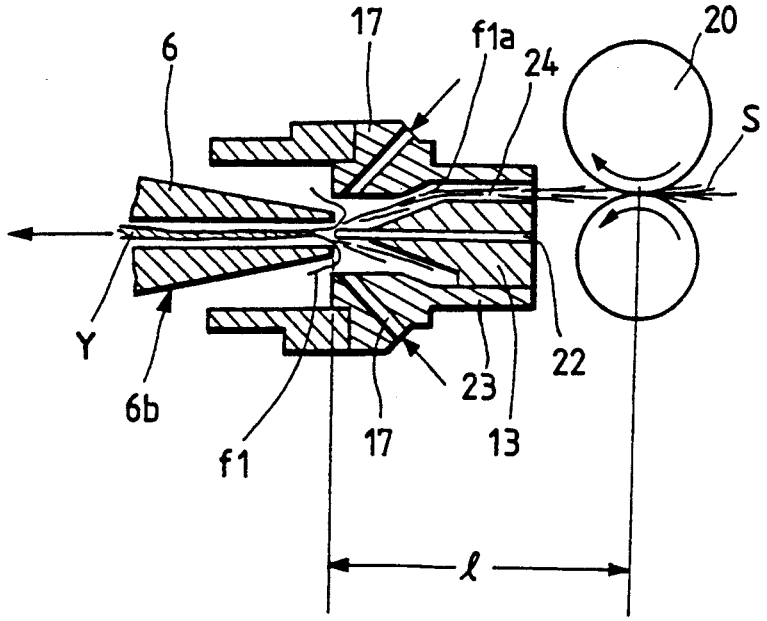
FIG. 3 is a schematic view showing the spinning state by the same apparatus.

In FIGS. 2 and 3, the extreme end of the guide member 22 is shown positioned somewhat inwardly of the passage 10 from the inlet 6a of the spindle 6. However, it may take a position away from the end of the inlet 6a, and can be set to a suitable position according to the conditions.

The guide member 22 has a function of a so-called false core, which impairs the propagation of twist in a yarn forming process later described or which temporarily performs a function in place of a center bundle of fibers, and has a function to impair the formation of a bundle of core fibers of zero twist remarkably appearing in a conventional pneumatic bundled spun yarn and to form a yarn by only wound fibers in fact.

In the spinning apparatus as explained above, assuming that the length of the nozzle block 23 is 15.5 mm, the diameter thereof is 7 mm, the diameter of the nozzle is 0.8 mm, and the jet air pressure is 4 kg/cm$^2$, a sliver of cottom having an average fiber length ($L_o$) of 25 mm was supplied to produce spun yarns. The relationship between the distance l from the spindle inlet 6a to the front rollers 20 (nip point N) and the state of producing yarns was observed.

As the result, it has been found that in the relationship of $l > L_o + L_o/2$, the strength of yarn is insufficient or continuity of yarn cannot be maintained, and in the relationship of $l < L_o - L_o/2$, the yarns produced are spun yarns in which other fibers are wound around the zero twist or low twist core fiber.

Accordingly, when the relationship of $L_o - L_o/2 < l < L_o + L_o/2$ is fulfilled, the real twist spun yarns can be produced.

Next, the process of producing yarns by the real twist yarn producing apparatus A will be described below.

The bundle of fibers S drafted by the draft device D and delivered from the front rollers 20 is drawn into the apparatus by an air stream sucked from the gap 24 between the guide member support member 13 and the nozzle block 23. Prior to the delivery of the bundle of fibers S from the front rollers 20, an extreme end of a suction pipe not shown is bought into contact with an outlet 30 of a cap 21 to generate an air stream sucked into the spindle 6. Accordingly, the bundle of fibers S which moves through the gap 24 is smoothly sucked into the spindle 6 by the air stream.

The yarn sucked into the suction pipe through the spindle 6 is introduced into a piecing device by the movement of the suction pipe, and is pieced with a yarn on the package side being introduced by a suction mouth.

The peripheral velocity of the delivery rollers provided at downstream of the outlet 30 of the cap 21 is set slightly larger than that of the front rollers 20 so as to always apply tension to the bundle of fibers S passing through the apparatus A during spinning.

The bundle of fibers S receives the action of a flow of compressed air which turns in the vicinity of the inlet 6a of the spindle 6 to be slightly twisted in the same direction. At that time, the bundle of fibers S is impossible to be positioned within the space occupied by the guide member 22 by the presence of the guide member 22. Accordingly, all the fibers fl are positioned around the guide member 22 and directly exposed to the air stream to receive a force to be separated from the bundle of fibers S. However, when the extreme end of the fiber fl is positioned at the inlet 6a of the spindle 6, the extreme end is twisted as previously described, and therefore, it is not easily separated. The rear end fl*a* of the fiber is not yet separated since it is nipped by the front rollers 20 as shown in FIG. 3 or positioned away from the nozzle 17 so that it will not receive much action of air.

When the rear end fl*a* of the fiber is disengaged from the front rollers 20 to assume a position which strongly receives an air stream from the nozzle 17, the fiber fl is separated from the bundle of fibers S. The extreme end of the fiber fl is not separated since it is subjected to partial twisting or it is inserted into the spindle 6 on which air less acts, and only the rear end fl*a* of the fiber rarely subjected to twisting action is separated from the bundle of fibers S. The rear end fl*a* of the fiber separated is wound once or plural times about the inlet 6a of the spindle 6 by the action of air, is then slightly wound about the conical portion 6b of the spindle 6 and thereafter is guided by the rotary member 9 to extend outwardly.

Since the bundle of fibers S keeps travelling leftward in the figure whilst the spindle 6 rotates, the rear end fl*a* of the fiber is gradually drawn while turning around the bundle of fibers S.

As the result, the fiber fl is helically wound around the bundle of fibers S, and the bundle of fibers S is formed into a spun yarn Y which passes through the fiber-bundle passage 10.

In the process of producing the yarn Y, the fiber fl is separated from everywhere in the entire outer periphery of the bundle of fibers S, the fiber positioned internally thereof is also exposed to the air stream and separated and the fiber assumes the outer periphery of the guide member 22, and therefore, a number of fibers are continuously separated. These separated fibers are evenly distributed to the conical portion 6*b* of the spindle 6, and fibers as the core are rarely present, and most fibers are twisted and wound to obtain a real twist yarn. The winding direction of these wound fibers fl is determined according to the direction of the nozzle 17 and the rotational direction of the spindle 6. The turning direction of the air stream caused by the nozzle 17 is preferably set in the same direction as the rotational direction of the spindle 6 so that the winding direction of the winding fiber fl is not disturbed and the extreme front end of the fiber is not separated.

As mentioned above, according to the apparatus of the present invention, the twisting which tends to be propagated from the spindle 6 toward the front rollers 20 is impaired in propagation by the guide member 22, and the bundle of fibers S moved out of the front rollers 20 is not twisted by the twisting but most of fibers are formed into wound fibers. This can be confirmed by the fact that in the case where the guide member 22 is not installed, stripe portions in a travelling direction are produced in the vicinity of the central portion widthwise of the rollers of flat-shaped fiber bundle delivered out of the front rollers 20.

Preferably, the extreme end of the guide member 22 is slightly moved into the passage of the spindle 6. The yarn produced in this state has an external appearance closest to the ring yarn but a yarn having an external appearance close to the ring yarn can be produced under the other conditions. These yarns are by no means inferior also in strength characteristics to the ring yarn.

While in this embodiment, a description has been made of the apparatus of the type in which twisting is applied by the spindle, it is to be noted that this can be applied to other spinning apparatuses, for example, such as a spinning apparatus in which a guide member is provided on a first nozzle inlet of a 2-nozzle type bundled spun yarn producing apparatus or by way of a nozzle and nip type twister, and a 1-nozzle type spinning apparatus depending on the conditions. Furthermore, the spindle 6 is provided to assist application of twist to the yarn. Even if the spindle 6 is not rotated, yarns can be produced depending on the yarns. Therefore, the spindle 6 need not always be rotated.

The present invention being constructed as described above, the effect as noted below can be attained.

More specifically, it is possible to produce real twist yarns which are extremely large in amount of wound fibers, and by no means inferior in external appearance and strength characteristics to ring yarns.

What is claimed is:

1. A spinning apparatus for spinning a fiber bundle provided by a draft device, the draft device including rollers defining a nip point, the fiber bundle including a plurality of fibers defining an average fiber length $L_o$, the apparatus comprising:

a nozzle block for imparting a turning air stream to the fiber bundle;

a spindle defining an axis and an inlet; and a guide member secured to the nozzle block, the guide member defining an axis and an end portion, the guide member arranged substantially coaxially with the spindle such that the end portion is substantially adjacent to the inlet;

wherein a distance from the inlet to the nip point is substantially between $\frac{1}{2}$ $L_o$ and $1\frac{1}{2}$ $L_o$.

2. The apparatus of claim 1, further comprising:

a support member for supporting the guide member, the support member and the nozzle block defining a passage for the fiber bundle.

3. The apparatus of claim 2, wherein the support member defines a generally columnar shape and a conically shaped end portion.

4. The apparatus of claim 1, wherein the spindle comprises a rotating spindle defining a conical portion.

5. The apparatus of claim 4, wherein the rotating spindle rotates in a same direction as the turning air stream.

6. The apparatus of claim 1, wherein the spindle comprises a stationary spindle defining a conical portion.

7. The apparatus of claim 1, wherein the guide member defines a generally pin-like shape, a curved end, and a diameter substantially smaller than the inlet.

8. The apparatus of claim 7, wherein the spindle defines a passage including the inlet and the curved end of the guide member is disposed substantially within the passage.

* * * * *